US012722852B2

(12) United States Patent
Bednarz et al.

(10) Patent No.: US 12,722,852 B2
(45) Date of Patent: Sep. 1, 2026

(54) CONTAINER AND INSERT ASSEMBLY

(71) Applicant: Illinois Tool Works Inc., Glenview, IL (US)

(72) Inventors: Mathew Bednarz, Schererville, IN (US); Karah Bishop, Jersey City, NJ (US); Alexander Lewis, Fort Mill, SC (US); Michael J. Schwab, Levittown, PA (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 18/480,051

(22) Filed: Oct. 3, 2023

(65) Prior Publication Data

US 2024/0109688 A1 Apr. 4, 2024

Related U.S. Application Data

(60) Provisional application No. 63/412,807, filed on Oct. 3, 2022.

(51) Int. Cl.

| | |
|---|---|
| ***B65D 85/672*** | (2006.01) |
| ***B65D 25/10*** | (2006.01) |
| ***B65D 65/38*** | (2006.01) |
| ***B65D 81/133*** | (2006.01) |

(52) U.S. Cl.

CPC ..... *B65D 25/103* (2013.01); *B65D 25/107* (2013.01); *B65D 65/38* (2013.01); *B65D 81/133* (2013.01); *B65D 2565/385* (2013.01); *B65D 2581/055* (2013.01)

(58) Field of Classification Search

CPC ..... B65D 5/5061; B65D 5/5088; B65D 5/02; B65D 73/0042; B65D 73/0078; B65D 85/672; B65D 85/676; B65D 25/103; B65D 25/107; B65D 65/38; B65D 81/133; B65D 2565/385

USPC ..... 206/389, 395, 413, 415, 416, 471, 485, 206/488, 583, 587

See application file for complete search history.

(56) References Cited

U.S. PATENT DOCUMENTS 4,027,794 A * 6/1977 Olson ..... B65D 5/5095 206/583
4,151,914 A * 5/1979 Blatt ..... B65D 85/66 206/386
5,704,479 A * 1/1998 Barnett ..... B65H 49/322 206/416

(Continued)

*Primary Examiner* — Luan K Bui
(74) *Attorney, Agent, or Firm* — Carroll, Hoette & Butscher, LLC; Christopher R. Carroll

(57) ABSTRACT

A container includes an outer box and an insert sized to fit inside the outer box. The insert includes a bottom wall, a first lateral end coupled to the bottom wall, and a second lateral end coupled to the bottom wall. The first lateral end opposes the second lateral end. The first lateral end may include a first outer wall and a first cradle wall spaced apart from the first outer wall. The first cradle wall may include a first cutout shaped to receive a flange at a first end of a spool of material. The second lateral end may include a second outer wall and a second cradle wall spaced apart from the second outer wall. The second cradle may include a second cutout opening shaped to receive a second end of the spool of the material. The insert may be formed from a rigid material.

18 Claims, 8 Drawing Sheets

(56) References Cited

U.S. PATENT DOCUMENTS 5,829,587 A * 11/1998 Saiki ..... B65D 5/54
206/327
6,685,025 B1 * 2/2004 Kari ..... B65D 5/5069
206/583
7,325,691 B2 * 2/2008 Siy ..... B65D 19/02
206/600

* cited by examiner

CONTAINER AND INSERT ASSEMBLY

CROSS-REFERENCE TO RELATED APPLICATIONS

This application claims priority to U.S. Provisional Application No. 63/412,807, filed on Oct. 3, 2022, the entire disclosure of which is incorporated herein by reference.

BACKGROUND

Technical Field

The subject matter described herein relates to containers and inserts for containers.

Discussion of Art

Containers can hold a variety of materials. In some examples, a container may include an insert to receive, stabilize, support, and/or preserve the contained material. The insert may provide needed clearance or support between the materials and the container. Currently, many containers and inserts are foldable boxes. These containers and inserts may require many different pieces, as well as a laborious and time-consuming process to manufacture and assemble. Additionally, the inserts may require separate portions to act as support and spacing elements to receive and hold container contents, for example a spool of material. A spool of material may have specific requirements for storage and transportation, such as being retained and supported around a core with a flange.

It may be advantageous to have an insert that is stable, easy to manufacture and assemble, and sustainable. It may be desirable to have containers and inserts that differ from those that are currently available.

BRIEF DESCRIPTION

In one example, a container is provided including an outer box and an insert that may fit inside the outer box. The insert may include a bottom wall, a first lateral end coupled to the bottom wall, and a second lateral end coupled to the bottom wall. The first lateral end may oppose the second lateral end. The first lateral end may include a first outer wall and a first cradle wall spaced apart from the first outer wall. The first cradle wall may include a first cutout shaped to receive a flange at a first end of a spool of material. The second lateral end may include a second outer wall and a second cradle wall spaced apart from the second outer wall. The second cradle may include a second cutout opening shaped to receive a second end of the spool of the material. The insert may be formed from a rigid material.

In one example, a container is provided that includes an outer box and an insert that may fit inside the outer box. The insert may include a bottom wall, a first lateral end coupled to the bottom wall, and a second lateral end coupled to the bottom wall. The first lateral end may oppose the second lateral end. The first lateral end may include a first outer wall and a first cradle wall spaced apart from the first outer wall. The first cradle wall may include a first cutout shaped to receive a first end of a spool of material. The second lateral end may include a second outer wall and a second cradle wall spaced apart from the second outer wall. The second cradle may include a second cutout opening shaped to receive a second end of the spool of the material. One or both of the first lateral end and the second lateral end may not bend or flex relative to the bottom wall.

In one example, a container is provided including an outer box and an insert that may fit inside the outer box. The insert may include a bottom wall, a first lateral end coupled to the bottom wall, and a second lateral end coupled to the bottom wall. The first lateral end may oppose the second lateral end. The first lateral end may include a first outer wall and a first cradle wall spaced apart from the first outer wall. The first cradle wall may include a first cutout shaped to receive a flange at a first end of a spool of material. The first cradle wall may be positioned to space the flange from the material. The second lateral end may include a second outer wall and a second cradle wall spaced apart from the second outer wall. The second cradle may include a second cutout opening shaped to receive a second end of the spool of the material.

BRIEF DESCRIPTION OF THE DRAWINGS

The inventive subject matter may be understood from reading the following description of non-limiting embodiments, with reference to the attached drawings, wherein below.

DETAILED DESCRIPTION

One or more embodiments of the inventive subject matter set forth herein include a container with an outer box and an insert. The insert may be formed from a single rigid body. By forming the insert from a single rigid body, the insert may be less laborious and time-intensive to manufacture and assemble, compared to currently available foldable inserts. Additionally, the insert may be stronger and more customizable to receive the desired materials. For example, where the material being stored and transported is a spool of material, the insert may be able to receive and support the spool of material, and specifically a flange of the spool. The support of the flange may space the flange from the material on the spool. By separating the flange and the material during storage and transportation, the insert may reduce damage or movement of the spool material. This all may be accomplished while having a container and insert that is simpler and more efficient to manufacture and assemble.

The sections that form the insert (e.g., a bottom wall, a first lateral end, a second lateral end) may be formed from a single material. Alternatively, the sections that form the insert may be formed from more than one material and formed into the insert.

Figure 1:
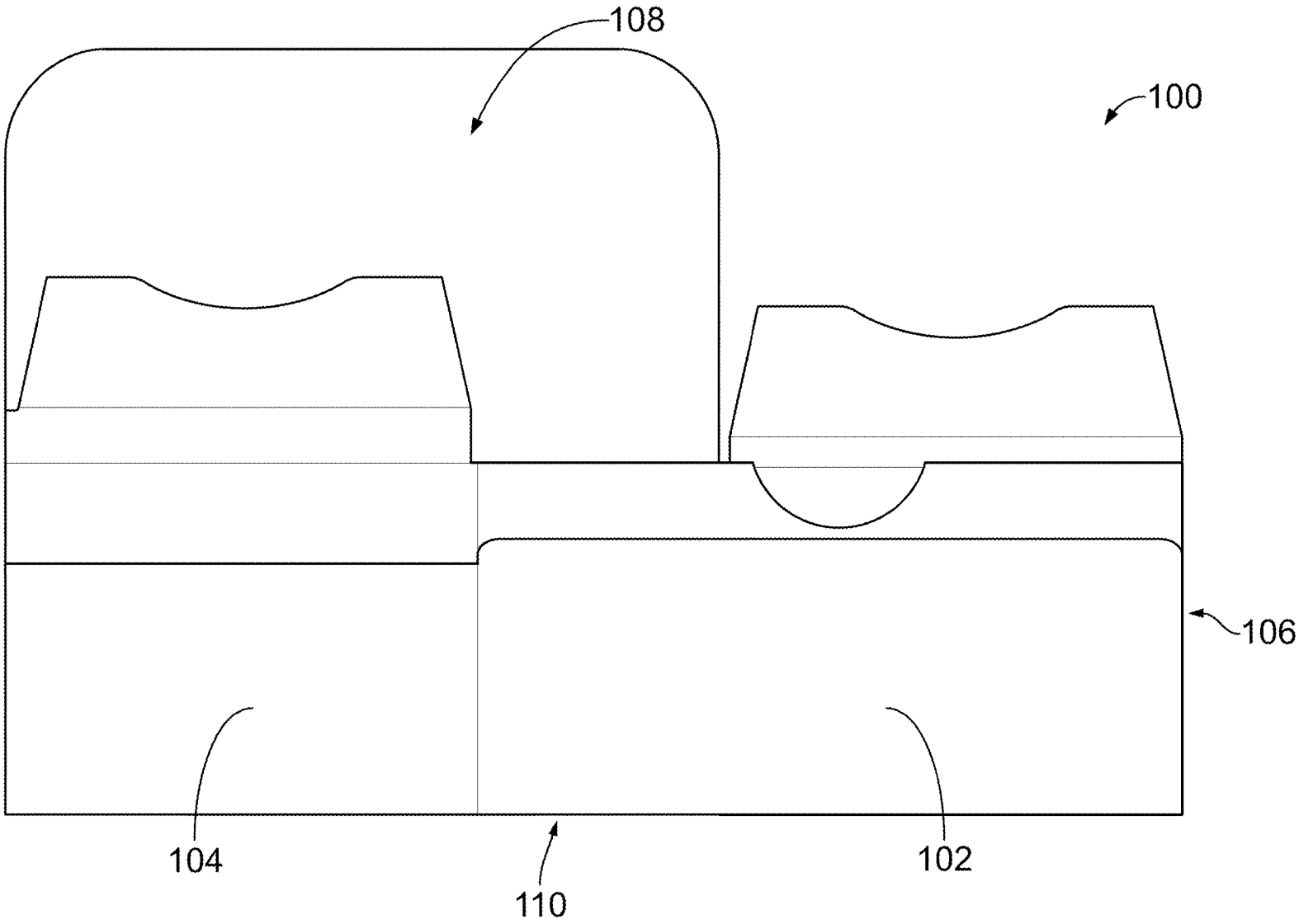
FIG. 1 illustrates a front view of one example of an outer box.

FIG. 1 shows a front view of one example of an outer box 100. The outer box is shown in a flat or non-assembled position. The outer box may include a front side 102, a back side (not shown), a first lateral side 104, a second lateral side 106, a bottom side 110, and an openable top side 108. In one example, the front side 102, the back side, and the first and second lateral sides 104, 106 may be coupled to the bottom side 110 and extend toward the openable top side 108. The outer box 100 may be formed from cardboard or another repulpable material. The outer box 100 may be folded to form an assembled position. In the assembled position, the outer box 100 may receive and hold materials, for example, through the openable top side 108. In some examples, the materials inserted into the outer box 100 may require additional support and securement beyond the outer box 100 alone. As discussed further herein, the outer box 100 may include an insert to secure the materials for carrying and transport.

Figure 2:
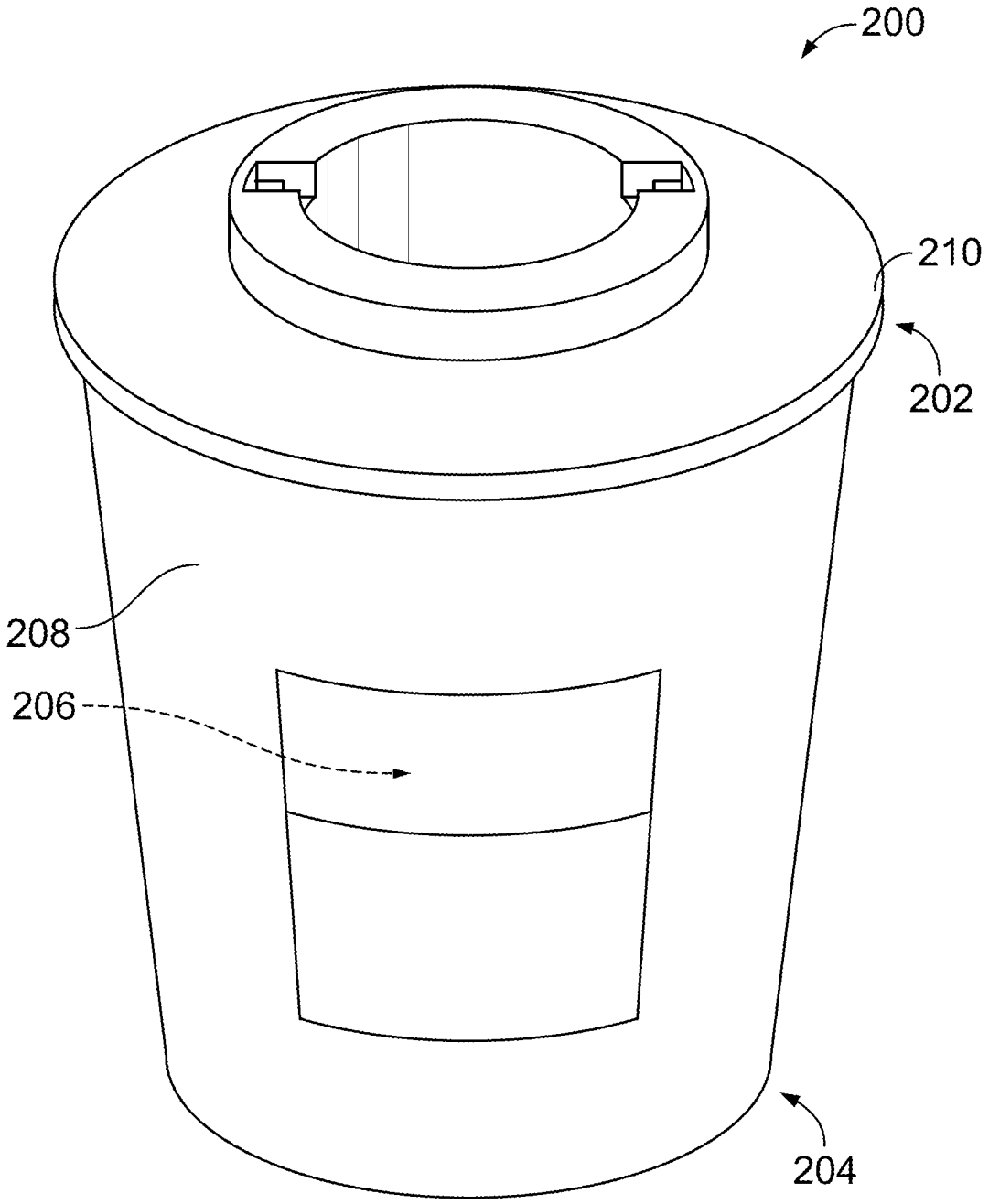
FIG. 2 illustrates a front view of one example of a spool.

FIG. 2 shows a front view of a spool 200. In one example, the spool 200 may be held or stored in a container. The spool 200 may include a first end 202 and a second end 204 opposite the first end 202. The spool 200 may include a core 206 that extends between the first end 202 and the second end 204. The spool 200 may include a material wrapped 208 around the core 206 to create a spool of material. In one example, the first end 202 may include a flange 210. The flange 210 may be adjacent but spaced apart by a distance from the material 208 on the spool 200. In one example, the distance between the material 208 and the flange 210 allows the material 208 to be removed from the spool 200 as the core 206 of the spool 200 rotates. Without the distance, the material 208 may move and engage the flange 210. The engagement and/or friction may inhibit the ability of the material to unwind from the core 206 and may prevent the spool 200 from rotating.

Figure 3:
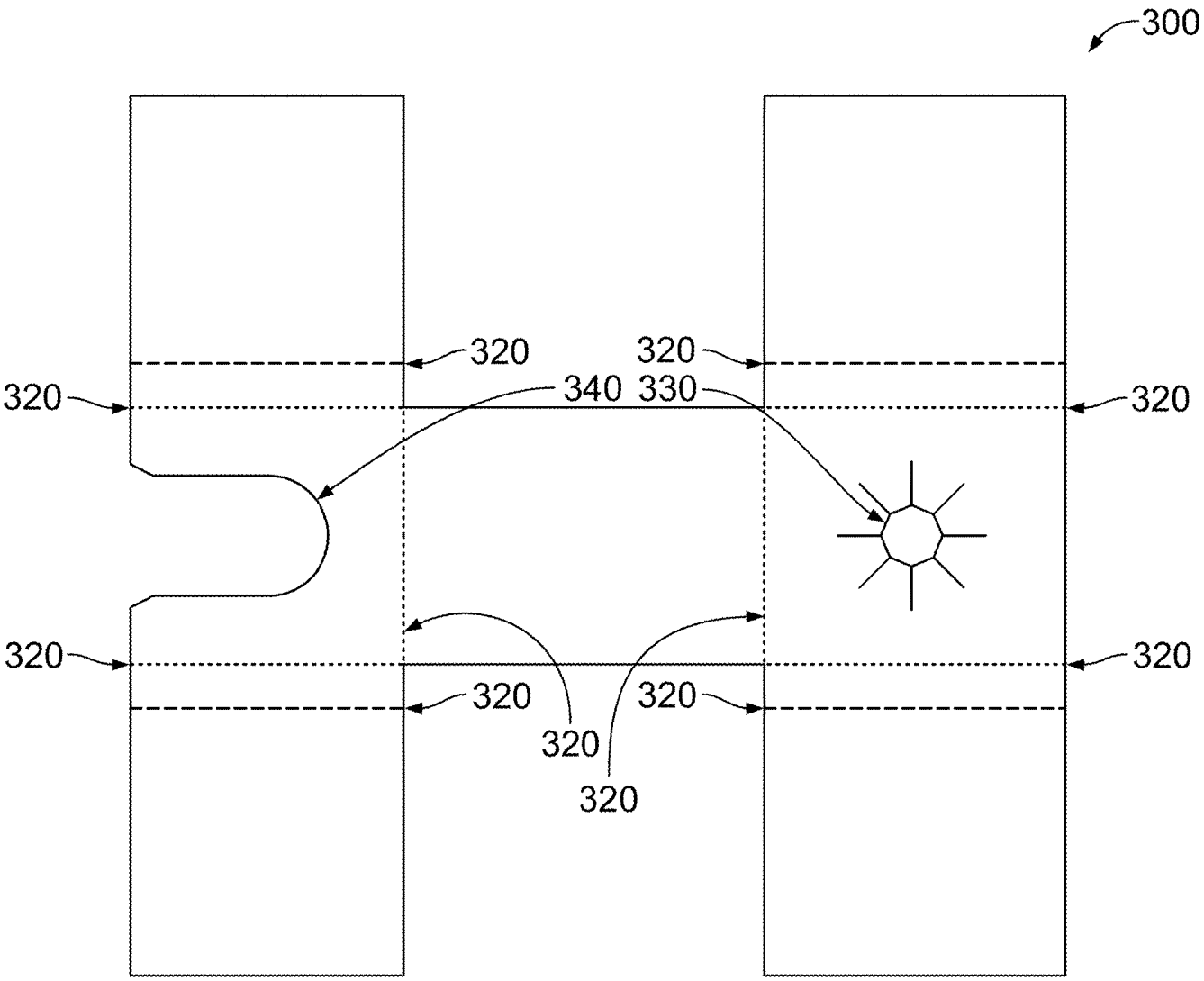
FIG. 3 illustrates a top view of one example of a foldable insert, shown in an unassembled position.

FIG. 3 shows one example of a foldable insert 300 for a container, shown in an unassembled position. The foldable insert 300 may be sized to fit inside of the outer box 100 illustrated in FIG. 1. The foldable insert 300 may be a flat sheet of material, such as cardboard, that may need to be folded several times to form the insert 300. The insert 300 may include fold portions 320 that indicate where the insert may need to be folded. The fold portions 320 may be positioned at perforated portions of the insert 300. In the example illustrated in FIG. 3, there may be ten separate fold portions 320. Each fold portion 320 may need to be folded to form the assembled insert 300. The assembled insert may be sized and shaped to retain the spool 200, described in FIG. 2. The insert 300 may require one or more punch out or cut out portions 330 to receive the first end 202 or the second end 204 of the spool 200. The punch out 330 may need to be punched out by a person or a machine, similar to the fold portions 320. The insert 300 may have an opening 340 positioned to receive the other of the first end 202 or the second end 204 of the spool 200. To secure the spool, the insert 300 may require separately formed spacers, as discussed below.

Figure 4:
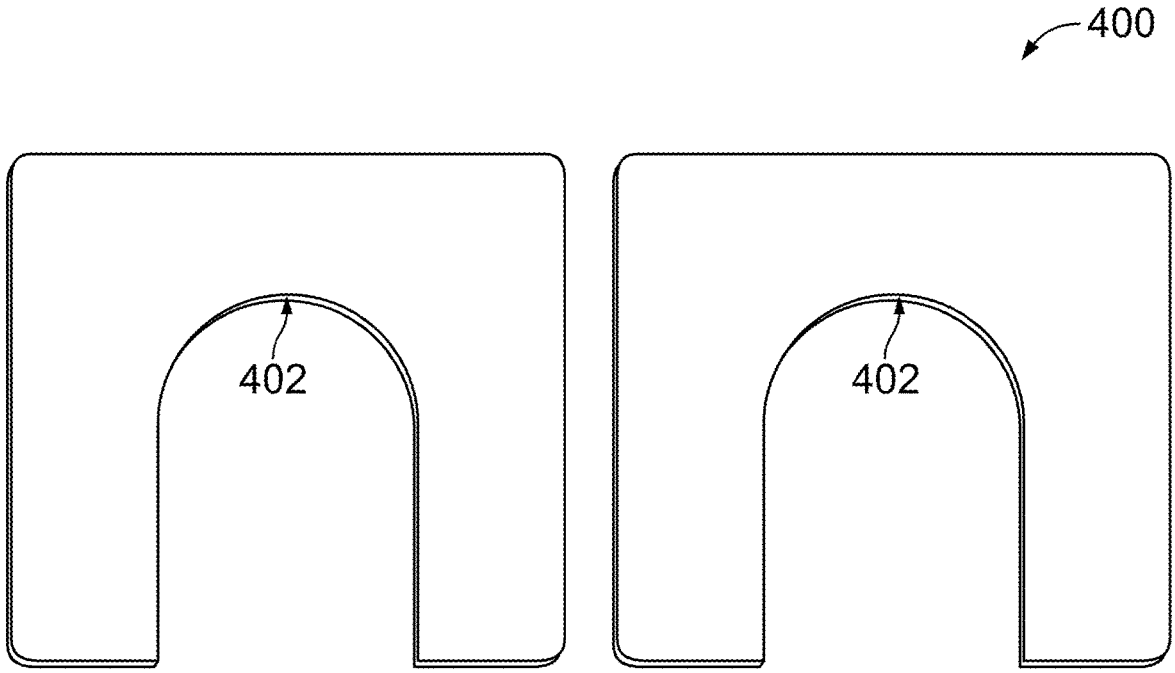
FIG. 4 illustrates a front view of one example of one or more first spacers for a container.

FIG. 4 shows one example of one or more first spacers 400 for a container. In the example shown in FIG. 4, there are two first spacers 400, however in other examples there may be one first spacer or more than two first spacers. The first spacer 400 may include a curved portion 402, for example a substantially U-shaped portion, as illustrated in FIG. 4. In other examples, the spacer 400 may include a portion of a different shape such as a square, a triangle, a trapezoid, an irregular polygon, an irregular curved shape, or the like. The first spacer 400 may be shaped to align with desired contents of the container. The first spacer 400 shown in FIG. 4 may be curved to receive the first end 202 of the spool 200, described in FIG. 2. Specifically, the first spacer 400 may receive the flange 210 of the first end 202 of the spool 200.

Figure 5:
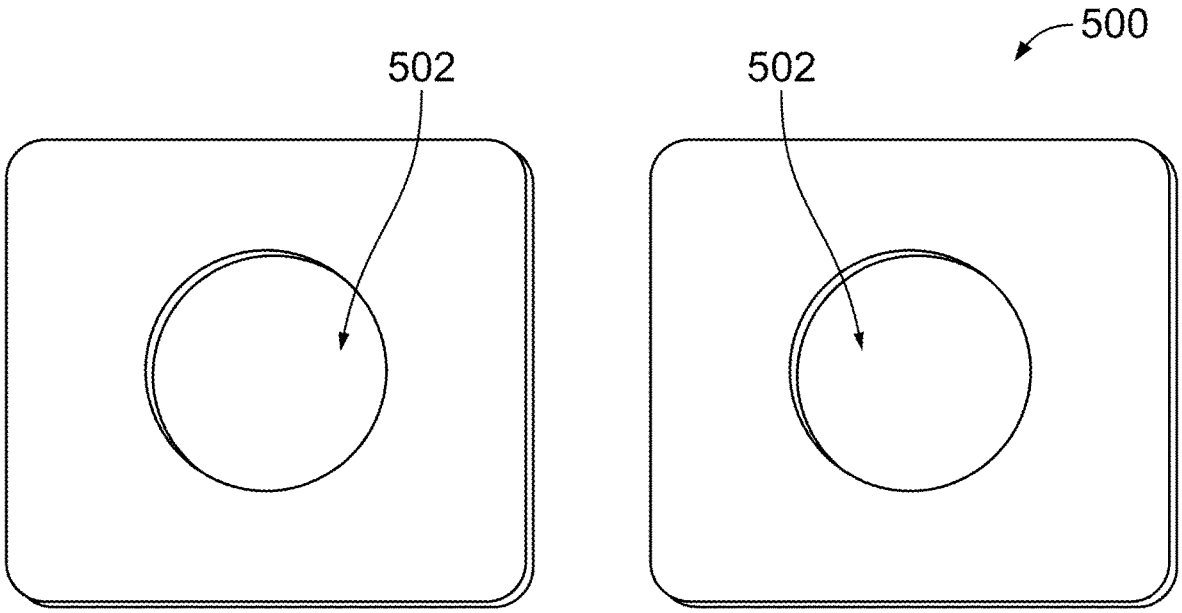
FIG. 5 illustrates a front view of one example of one or more second spacers for a container.

FIG. 5 shows one example of one or more second spacers 500 for the container. In the example shown in FIG. 5, there are two second spacers 500, however in other examples there may be one second spacer or more than two second spacers. The second spacer 500 may be substantially square shaped with an opening 502 in a middle portion. In another example, the opening of the second spacer 500 may be of a different shape, such as a rectangle, a circle, an oval, a trapezoid, an irregular polygon, or an irregular curved shape. The second spacer 500 may be sized and shaped to align with the desired contents of the container. The opening 502 in the second spacer 500 may be positioned to receive a portion of the contents of the container. In one example, the opening 502 in the second spacer 500 may be sized and positioned to receive the second end 204 of the spool 200. The second spacer 500 may help support or secure the second end 204 of the spool 200.

Figure 6:
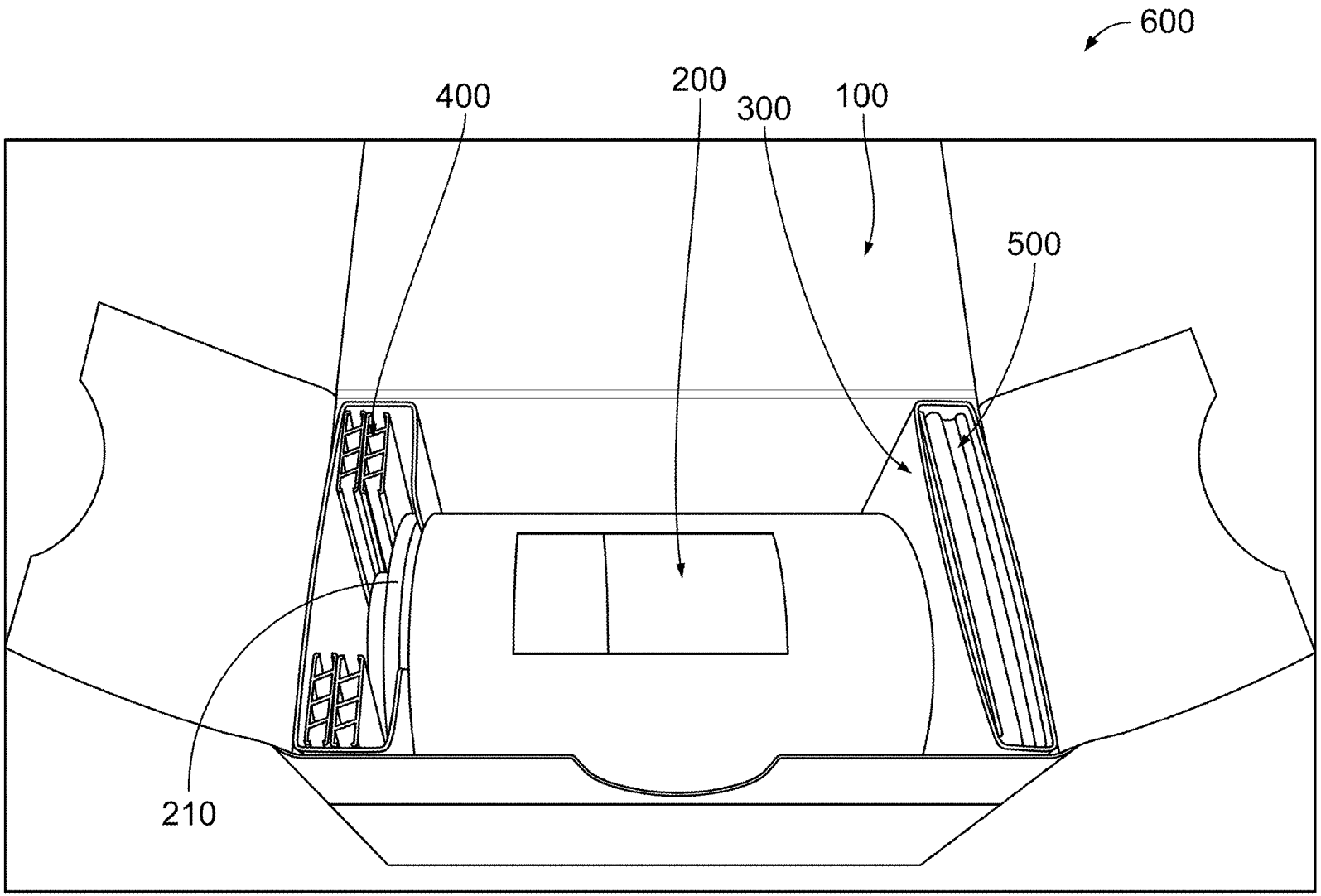
FIG. 6 illustrates a top view of one example of a container with an outer box, a foldable insert, spacers, and a spool.
Figure 7:
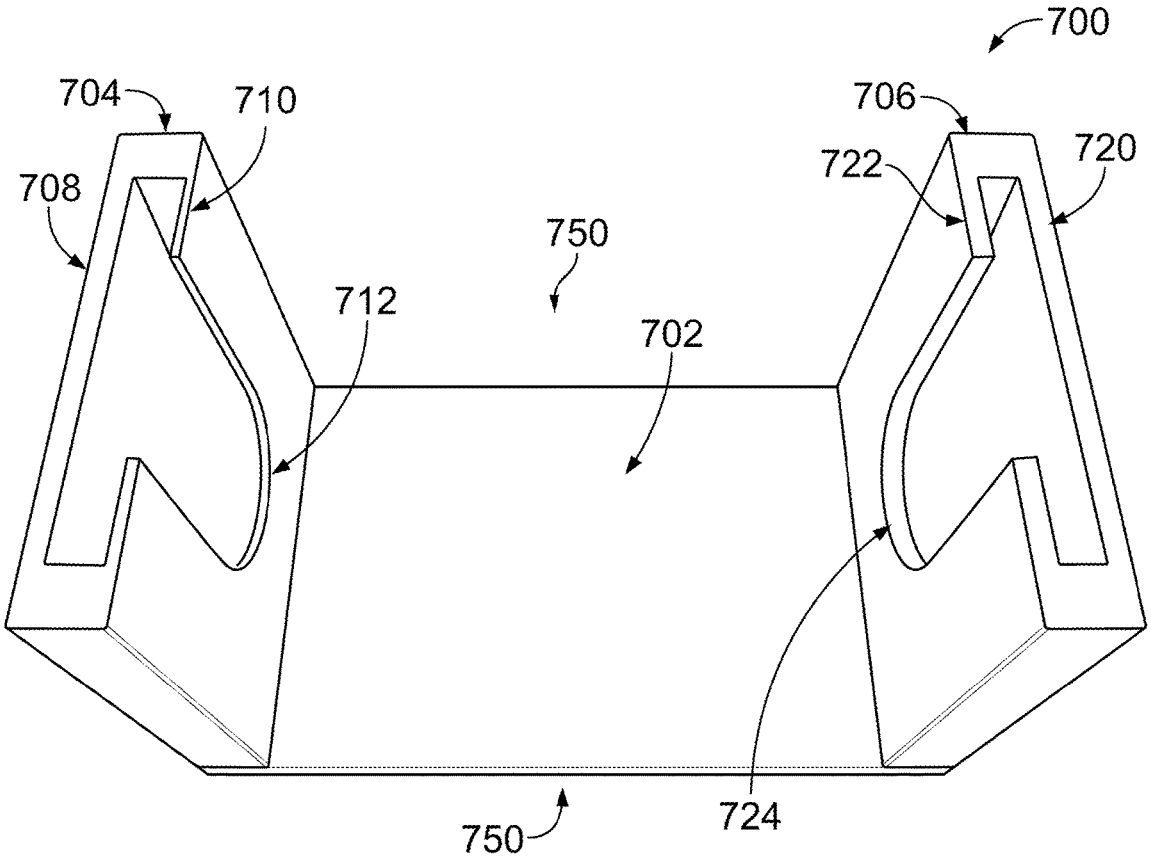
FIG. 7 illustrates a perspective view of one example of a rigid insert.

The first and second spacers 400, 500 may be formed independently of the insert 300, as illustrated in FIGS. 4 and 5. Once the insert 300 is assembled, the first and second spacers 400, 500 may be positioned to fit at opposite sides of the insert 300. FIG. 6 shows one example of a container assembly 600 with the outer box 100, the foldable insert 300, the first and second spacers 400, 500, and the spool 200. Based on FIGS. 1-6, it may be appreciated that the foldable insert arrangement may require many steps and may be difficult to manufacture and assemble.

With the foldable insert and spacers arrangement, the container may require several separate pieces as well as assembly of one or more of the components. For example, the insert may require several folds to form the assembled insert. Additionally, the insert may require the punched out or cut out portion. The first and second spacers may need to be manufactured and subsequently inserted into the assembled insert. Finally, the insert and spacers are placed into the outer box to complete the container. This process may require a lot of material and labor input. Additionally, the process may be difficult to accomplish and repeat consistently.

FIGS. 7-11 show another example of a rigid insert 700, according to one example. The rigid insert may include a bottom wall 702, a first lateral end 704 coupled to the bottom wall 702, and a second lateral end 706 coupled to the bottom wall 702. The first lateral end 704 may be opposite the second lateral end 706. The first lateral end 704 may include a first outer wall 708 and a first cradle wall 710 spaced apart from the first outer wall 708. The first cradle wall 710 may include a first cutout 712 shaped to receive the flange 210 at the first end 202 of the spool 200, as shown in FIG. 2. The second lateral end 706 may include a second outer wall 720 and a second cradle wall 722 spaced apart from the second outer wall 720. The second cradle wall 722 may include a second cutout 724 shaped to receive the second end 204 of the spool 200.

Figure 8:
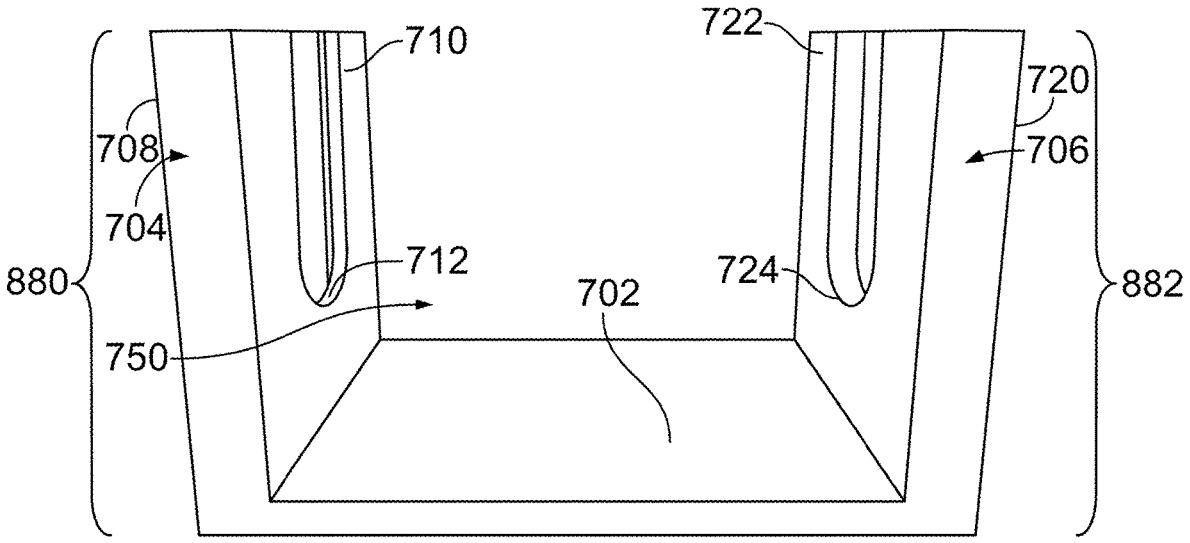
FIG. 8 illustrates a side view of one example of a rigid insert.
Figure 9:
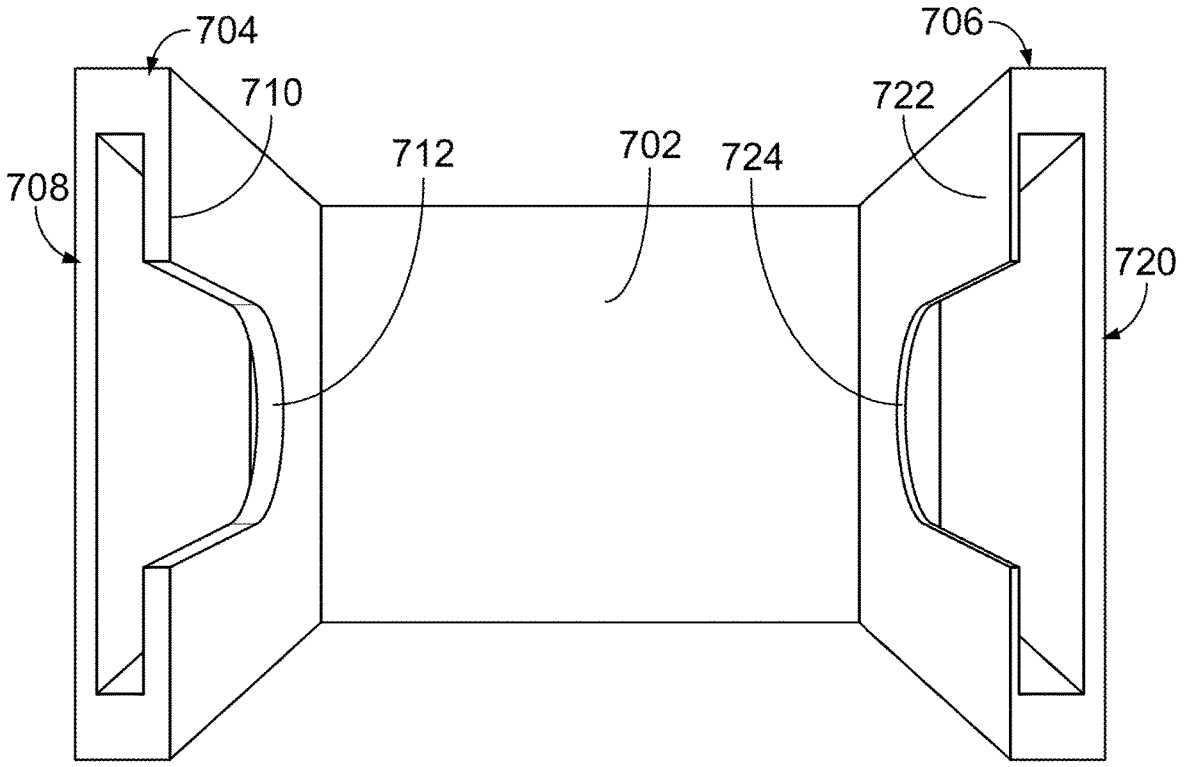
FIG. 9 illustrates a top view of one example of a rigid insert.
Figure 10:
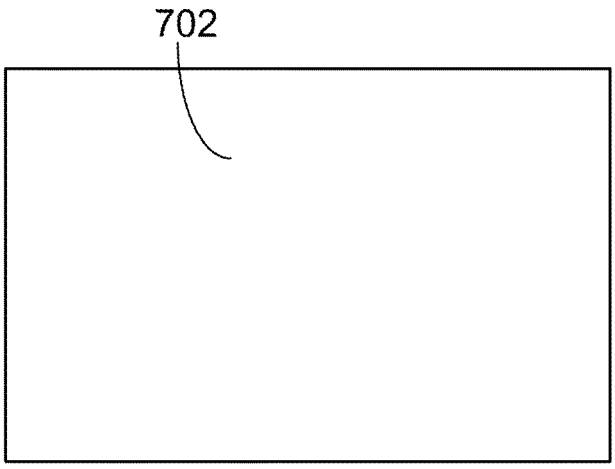
FIG. 10 illustrates a bottom view of one example of a rigid insert.
Figure 11:
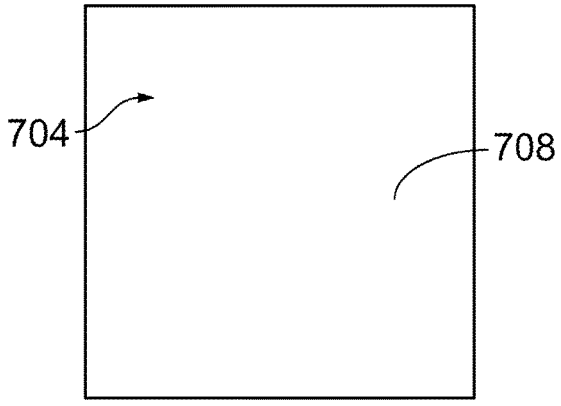
FIG. 11 illustrates an end view of one example of a rigid insert.

The rigid insert 700 may be formed as a single piece by additive manufacturing, injection molding, extrusion, blow molding, thermoforming, or the like. The rigid insert may be formed from a single material, such as a polymer, or formed from different materials. The first lateral end 704 and the second lateral end 706 may be positioned generally perpendicular to the bottom wall 702. As used herein, generally perpendicular may include exactly perpendicular or within a few degrees of perpendicular, for example, within 15 degrees or less of perpendicular. In one example, the first lateral end 704 and the second lateral end 706 may be formed to not bend or flex relative to the bottom surface 702. Said another way, the first lateral end 704 and the second lateral end 706 may be generally rigid and stationary with respect to the bottom surface 702. In one example, the first lateral end 704 may include a hinge that allows the first lateral end 704 to move between an upright position where the first lateral end 704 is generally perpendicular to the bottom surface 702 and a flat position, where the first lateral end 704 is collapsed and substantially flat or parallel relative to the bottom surface. The hinge may allow the first lateral end 704 to move such that the first lateral end 704 is adjacent to or on top of the bottom surface 702 in the flat position or the first lateral end 704 extends away from the bottom surface 702 in the flat position. In one example, the second lateral end 706 may have a hinge similar to that discussed for the first lateral end 704. In one example, both the first lateral end 704 and the second lateral end 706 include the hinge. However, in another embodiment, only one of the first lateral end 704 and the second lateral end 706 include the hinge. The first lateral end 704 may extend away from the bottom wall 702 a first height 880 and the second lateral end 706 may extend away from the bottom wall 702 a second height 882, as illustrated in FIG. 8. In one example, the first height 880 and the second height 882 may be substantially the same. However, in another example, the first height 880 may be greater than the second height 882. In another example, the first height 880 may be less than the second height 882. The first and second heights 880 and 882 may be modified to accommodate the size and shape of desired contents to be secured by the insert, specifically to be compatible with the different spool and flange arrangements.

In one example, the first cutout 712 and the second cutout 724 may be the same shape and the same size. In one example, the first cutout 712 and the second cutout 724 may be the same shape and a different size. In one example, the first cutout 712 and the second cutout 724 may be a different shape and a different size.

The rigid insert 700 may be beneficial over the foldable insert 300 because it may be less time and labor intensive to manufacture and assemble. The rigid insert 700 may require substantially fewer pieces and steps during the manufacturing and assembly process. Additionally, the rigid insert 700 may be formed from a durable material, such that the rigid insert may be capable of being reused.

The rigid insert 700 may be shaped such that the rigid insert 700 may include open portions 750 along the bottom surface 702 between the first lateral end 704 and the second lateral end 706. The open portions 750 may permit the rigid insert to be manufactured using less material. Additionally, the open portions 750 may allow for more flexibility as to what the insert may be capable of holding and supporting. For example, the open portions 750 may permit holding of a material that has a lateral length that extends beyond the bottom surface. As used herein, a lateral length may extend in a direction of the open portions 750 and generally transverse to a direction between the first lateral end 704 and the second lateral end 706. In another example, the rigid insert 700 may not include open portions 750, but rather, may have solid portions coupled to the bottom surface 702 extending between the first lateral end 704 and the second lateral end 706.

In one example, the rigid insert 700 may be manufactured by injection molding, blow molding, extrusion, thermoforming, or the like. The rigid insert may be formed from thermoplastics and thermosetting polymers, elastomers, metals, or the like. In another example, the rigid insert 700 may manufactured using additive manufacturing. The rigid insert may be formed from several layers of material bonded together. The process may be done using computer-aided-design (CAD) or a 3D object scanner to direct hardware to deposit material, layer upon layer, in precise geometric shapes to create the rigid insert 700.

Figure 12:
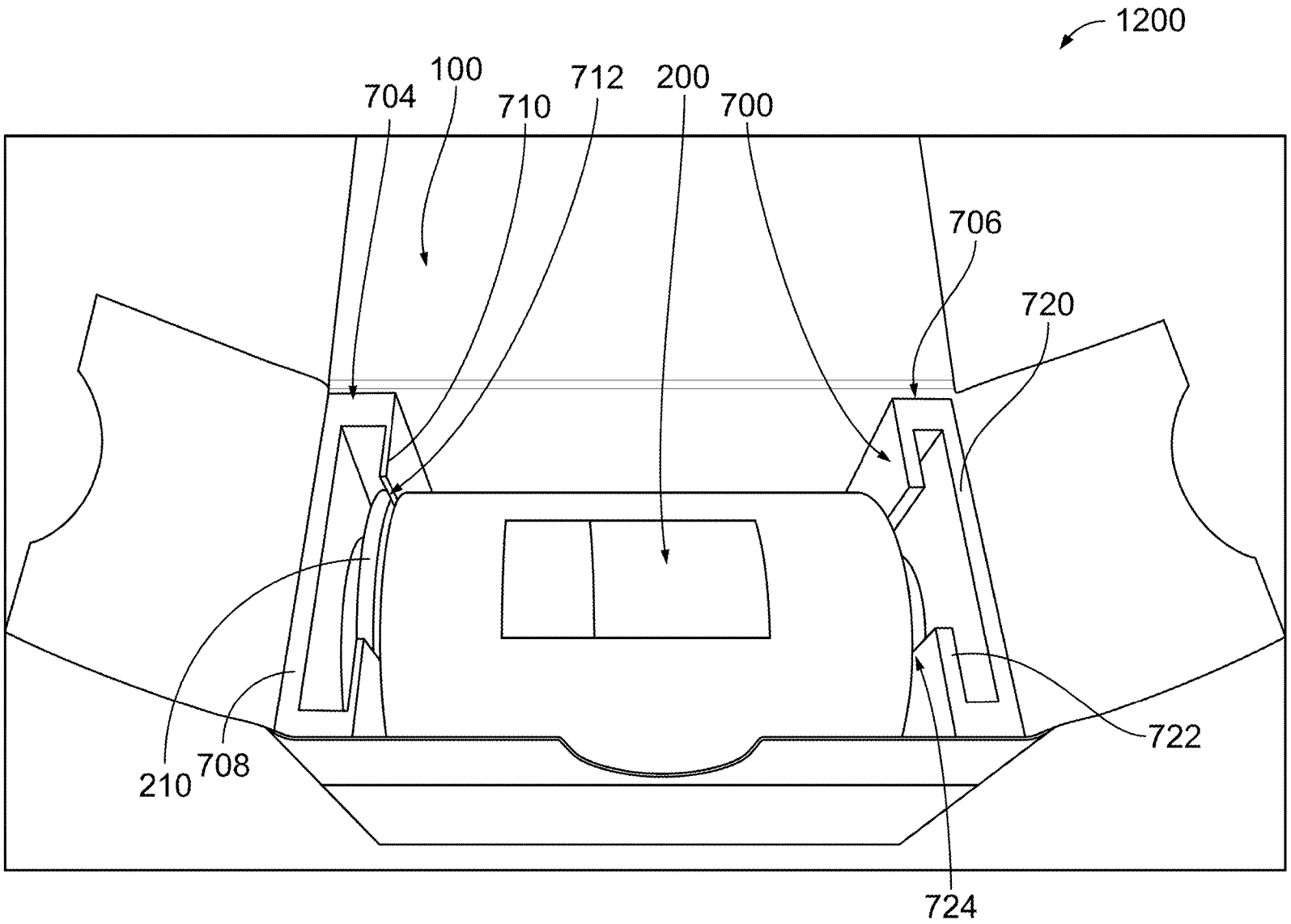
FIG. 12 illustrates a top view of one example of a container with an outer box, a rigid insert, and a spool.

FIG. 12 shows one example of a container 1200 including the outer box 100, the rigid insert 700, and the spool 200. The first end 202 of the spool 200 may be positioned to be received into the first cutout 712 of the rigid insert 700. More specifically, the flange 210 of the first end 202 may be received into the first cutout 712. As illustrated in FIG. 12, the first cradle wall 710 and the first cutout 712 may be positioned and shaped to extend between the flange 210 and the material 208 of the spool 200. The positioning of the first cradle wall 710 may allow for a gap between the material 208 and the spool 200. The first cradle wall 710 may serve as a first spacer between the flange 210 and the material 208. The first cradle wall 710 and the first cutout 712 may be adjusted to accommodate a desired spool size and geometry. For example, the size, shape, and thickness of the first cradle wall 710 and the first cutout 712 may be modified to ensure that the flange 210 may be received within the first cutout 712 and the first cradle wall 710 may space the flange 210 from the material 208. If a different spool and flange arrangement may be used, the rigid insert 700, first cradle wall 710, and the first cutout 712 may be modified, accordingly, to be compatible with the different spool and flange arrangement.

The gap or distance may allow the material 208 to rotate about the core 206, for example, where the material 208 is being removed from the spool 200. Without the gap or the distance, the material 208 may move and engage the flange 210. The engagement and/or friction may inhibit the material's ability to rotate about the core 206. The likelihood of movement of the material 208 toward the flange 210 may be increased during transit of the spool 200 in the container 800. Drops and turbulence may be more likely during transit. Thus, the size and positioning of the first cradle wall 710 and the first cutout 712 may secure the spool 200 such that there may be less risk of damage during transit. In one example, the gap or the distance is between 0.25 millimeter and 15 millimeters. In one example, the gap or the distance may be substantially the same size as a thickness of the first cradle wall 710.

In one example, the first outer wall 708 may be the same thickness as the first cradle wall 710. In another example, the first outer wall 708 may be a greater thickness than the first cradle wall 710. This may allow the first lateral end 704 to have a greater strength, which may be beneficial during transit. Additionally, the first cradle wall 710 having a lesser thickness than the first outer wall 708 may allow the first cradle wall 710 to fit more easily between the material 208 and the flange 210. This positioning of the first cradle wall 710 may fill space between the material 208 and the flange 210 to reduce slippage of the material 208 on the spool 200. In one example, the first outer wall 708 may be a lesser thickness than the first cradle wall 710. This may allow the rigid insert 700 to use less overall material and may allow the insert to receive and hold larger materials.

In one example, the second outer wall 720 may be the same thickness as the second cradle wall 722. In another example, the second outer wall 720 may be a greater thickness than the second cradle wall 722. This may allow the second lateral end 706 to have a greater strength, which may be beneficial during travel. In one example, the second outer wall 720 may be a lesser thickness than the second cradle wall 722. This may allow the rigid insert 700 to use less overall material and may allow the insert to receive and hold larger materials.

In one example, the first lateral end 704 and the second lateral end 706 may be generally symmetrical. In another example, the first lateral end 704 and the second lateral end 706 may be asymmetrical.

In accordance with one example or aspect, a container is provided that may include an outer box and an insert configured to fit inside the outer box. The insert may include a bottom wall, a first lateral end coupled to the bottom wall, and a second lateral end coupled to the bottom wall. The first lateral end may oppose the second lateral end. The first lateral end may include a first outer wall and a first cradle wall spaced apart from the first outer wall. The first cradle wall may have a first cutout shaped to receive a flange at a first end of a spool of material. The second lateral end may include a second outer wall and a second cradle wall spaced apart from the second outer wall. The second cradle may have a second cutout opening shaped to receive a second end of the spool of the material. The insert may be formed from a rigid material.

In one example, the insert may be formed of a single material. The insert may be formed from a polymer. The insert may be formed from several layers of material bonded together. The insert may be injection molded. The first lateral end may be generally perpendicular to the bottom wall and the second lateral end may be generally perpendicular to the bottom wall. In one example, one or both of the first lateral end or the second lateral end may not bend or flex relative to the bottom wall.

The first cutout and the second cutout may be different sizes. However, in another example, the first cutout and the second cutout may be the same size. The first cutout may provide a distance between 0.25 millimeters and 7 millimeters between the flange and the spool of material. In one example, the first cradle wall may include a first spacer. The insert may be open between the first lateral end and the second lateral end.

In accordance with one example or aspect, a container is provided that may include an outer box and an insert configured to fit inside the outer box. The insert may include a bottom wall, a first lateral end coupled to the bottom wall, and a second lateral end coupled to the bottom wall. The first lateral end may oppose the second lateral end. The first lateral end may include a first outer wall and a first cradle wall spaced apart from the first outer wall. The first cradle wall may have a first cutout shaped to receive a first end of a spool of material. The second lateral end may include a second outer wall and a second cradle wall spaced apart from the second outer wall. The second cradle may have a second cutout opening shaped to receive a second end of the spool of the material. One or both of the first lateral end or the second lateral end may not bend or flex relative to the bottom wall.

In one example, the insert may be formed of a rigid material. The insert may be formed from a recyclable material. The first cutout may receive a flange at the first end of the spool material. The first cutout may provide a distance between 1 millimeter and 7 millimeters between the flange and the spool of material. In one example, the first cutout and the second cutout may be different sizes. In another example, the first cutout and the second cutout may be the same size.

In accordance with one example or aspect, a container is provided that may include an outer box and an insert configured to fit inside the outer box. The insert may include a bottom wall, a first lateral end coupled to the bottom wall, and a second lateral end coupled to the bottom wall. The first lateral end may oppose the second lateral end. The first lateral end may include a first outer wall and a first cradle wall spaced apart from the first outer wall. The first cradle wall may have a first cutout shaped to receive a flange at a first end of a spool of a material. The first cradle wall may space the flange from the material. The second lateral end may include a second outer wall and a second cradle wall spaced apart from the second outer wall. The second cradle may have a second cutout opening shaped to receive a second end of the spool of the material.

In accordance with one example or aspect, an insert for a container is provided that may include a bottom wall, a first lateral end coupled to the bottom wall, and a second lateral end coupled to the bottom wall. The first lateral end may oppose the second lateral end. The first lateral end may include a first outer wall and a first cradle wall spaced apart from the first outer wall. The first cradle wall may have a first cutout shaped to receive a flange at a first end of a spool of a material. The first cradle wall may space the flange from the material. The second lateral end may include a second outer wall and a second cradle wall spaced apart from the second outer wall. The second cradle may have a second cutout opening shaped to receive a second end of the spool of the material.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may not be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A container comprising:

an outer box;

a spool of material disposed in the outer box, the spool of material comprising a spool having a core located between a first end and a second end of the spool of material and a material wrapped around the core, wherein the first end further comprises a flange;

an insert configured to fit inside the outer box, the insert comprising:

a bottom wall, a first lateral end coupled to the bottom wall, and a second lateral end coupled to the bottom wall, the first lateral end opposing the second lateral end;

the first lateral end including a first outer wall and a first cradle wall spaced apart from the first outer wall, the first cradle wall having a first cutout that is open along an upper edge of the first cradle wall, the first cutout shaped to receive the flange of the spool of material, wherein the flange is located between the first outer wall and the first cradle wall;

the second lateral end includes a second outer wall and a second cradle wall spaced apart from the second outer wall, the second cradle wall having a second cutout opening shaped to receive the second end of the spool of the material; and a spacer located between the first outer wall and the first cradle wall, wherein the spacer comprises a third cutout that is open along an upper edge of the spacer and that is shaped to receive the flange of the spool of material.

2. The container of claim 1, wherein the insert is formed of a single material.

3. The container of claim 1, wherein the first lateral end is perpendicular to the bottom wall and the second lateral end is perpendicular to the bottom wall.

4. The container of claim 1, wherein one or both of the first lateral end or the second lateral end do not bend or flex relative to the bottom wall.

5. The container of claim 1, wherein the first cutout and the second cutout are different sizes.

6. The container of claim 1, wherein the first cutout and the second cutout are a same size.

7. The container of claim 1, wherein the insert is formed from a polymer.

8. The container of claim 1, wherein the first cutout provides a distance between 0.25 millimeters (mm) and 7 mm between the flange and the spool of material.

9. The container of claim 1, wherein the insert is open between the first lateral end and the second lateral end.

10. The container of claim 1, wherein the insert is formed from several layers of material bonded together.

11. The container of claim 1, wherein the insert is injection molded.

12. A container comprising:

an outer box;

a spool of material disposed in the outer box, the spool of material comprising a spool having a core located between a first end and a second end of the spool of material and a material wrapped around the core, wherein the first end further comprises a flange;

an insert configured to fit inside the outer box, the insert comprising:

a bottom wall, a first lateral end coupled to the bottom wall, and a second lateral end coupled to the bottom wall, the first lateral end opposing the second lateral end;

the first lateral end including a first outer wall and a first cradle wall spaced apart from the first outer wall, the first cradle wall having a first cutout that is open along an upper edge of the first cradle wall, the first cutout shaped to receive the flange of the spool of material;

the second lateral end including a second outer wall and a second cradle wall spaced apart from the second outer wall, the second cradle wall having a second cutout opening that is open along an upper edge of the second cradle wall, the second cutout opening shaped to receive the second end of the spool of the material.

13. The container of claim 12, wherein the insert is formed of a rigid material.

14. The container of claim 12, wherein the first cutout is configured to receive the flange at the first end of the spool of material.

15. The container of claim 14, wherein the first cutout provides a distance between 1 millimeter (mm) and 7 mm between the flange and the spool of material.

16. The container of claim 12, wherein the first cutout and the second cutout are different sizes.

17. The container of claim 12, wherein the first cutout and the second cutout are a same size.

18. The container of claim 12, wherein the insert is formed from a recyclable material.

* * * * *